United States Patent [19]

Reynolds

[11] 4,116,522

[45] Sep. 26, 1978

[54] SLOTTED TERMINAL

[75] Inventor: Charles Edward Reynolds, Mechanicsburg, Pa.

[73] Assignee: AMP Incorporated, Harrisburg, Pa.

[21] Appl. No.: 856,877

[22] Filed: Dec. 2, 1977

Related U.S. Application Data

[63] Continuation of Ser. No. 703,725, Jul. 9, 1976, abandoned, which is a continuation-in-part of Ser. No. 607,401, Aug. 25, 1975, abandoned.

[51] Int. Cl.[2] ..... H01R 11/20

[52] U.S. Cl. ..... 339/97 R

[58] Field of Search ..... 339/97–99

[56] References Cited

U.S. PATENT DOCUMENTS

| | | | |
|---|---|---|---|
| 3,605,072 | 9/1971 | Driscoll | 339/98 |
| 3,617,983 | 11/1971 | Patton | 339/98 |
| 3,636,500 | 1/1972 | Sedlacek | 339/97 R |
| 3,854,114 | 12/1974 | Kloth et al. | 339/97 R |
| 3,895,852 | 7/1975 | Wasserlein, Jr. | 339/99 R |
| 3,932,017 | 1/1976 | Dechelette | 339/97 P |

FOREIGN PATENT DOCUMENTS

| | | | |
|---|---|---|---|
| 2,254,318 | 5/1974 | Fed. Rep. of Germany | 339/97 R |
| 1,665,982 | 2/1971 | Fed. Rep. of Germany | 339/97 P |
| 2,142,850 | 3/1973 | Fed. Rep. of Germany | 339/97 R |

*Primary Examiner*—Joseph H. McGlynn

[57] ABSTRACT

A U-shaped terminal having a pair of plate-like legs joined together at one end thereof by a transverse section. A wire insertion slot is formed across said transverse section and extends down into said legs. The slot is relatively wide across the transverse section and as it enters said legs becomes narrower than the wire to be inserted therein, and causes some ovalization of the wire. An abrupt change in slot width occurs by means of shoulders formed in the slot walls in the legs, and below which the slot width is smaller still, at least in one leg, than the ovallizing dimension of the slot above the shoulders. The shoulders bite into and strip away insulation as the conductor is forced thereby, leaving the bare metal of the wire in contact with the slot edges as the wire is forced farther therein. The legs can lie in planes which converge towards the transverse element so that as the wire is inserted in the slots the legs will, in relation to the wire, move apart and thereby scrape away the insulation on the wire. Additional slots can be formed on one or both sides of the wire insertion slot to form beam-like elements therebetween which bend resiliently as the wire is forced into the wire insertion slot, thereby coacting with the insulation stripping means to maintain a long term, spring-like force between the exposed bare metal of the wire and the slot walls.

2 Claims, 14 Drawing Figures

FIG. 10
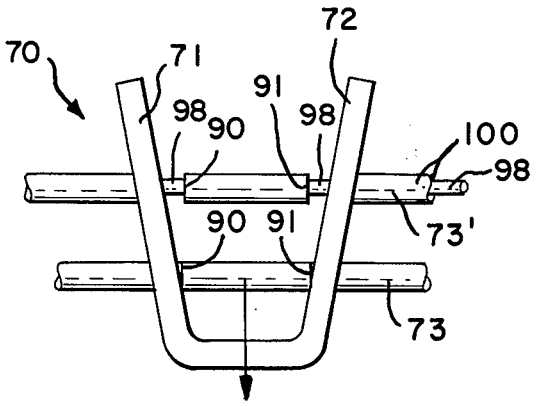
FIG. 11
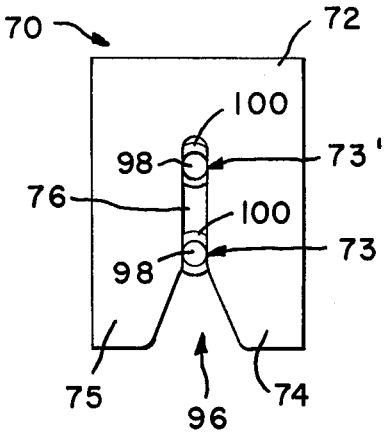
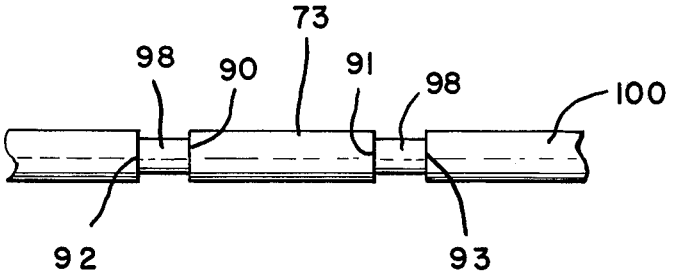
FIG. 12
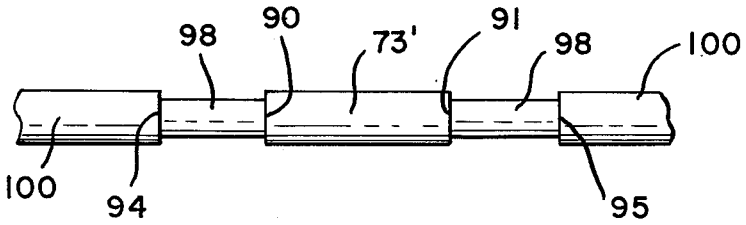
FIG. 13

SLOTTED TERMINAL

CROSS-REFERENCE TO RELATED APPLICATION

This is a continuation of application Ser. No. 703,725 filed July 9, 1976, by Charles Edward Reynolds entitled "Slotted Terminal," now abandoned, and which is a continuation-in-part of application Ser. No. 607,401 filed Aug. 25, 1975, by Charles Edward Reynolds for "Slotted Terminal," now abandoned.

BACKGROUND OF THE INVENTION

This invention relates generally to solderless connectors, and more particularly to solderless connectors of the type wherein a wire is forced into a narrow slot formed in a conductive metal plate and wherein the walls of the slot dig into the insulation and into the wire as said wire enters, thereby making good electrical and mechanical connections.

There are many connectors in the prior art utilizing the basic principle of a slot formed in a metal plate wherein the width of the slot is narrower than the diameter of a wire forced therein. When the wire is forced into the slot the walls of said slot dig through the insulation on the wire to make electrical and mechanical connection therewith.

One such device consists of a U-shaped terminal having two plate-like legs joined together at first ends thereof by a transverse section. A slot is formed across said transverse section between said two legs and extending down into the said two legs. Further, the slot is wide at the top across the transverse section to permit easy entry of a wire therein, and then narrows as the slot enters the legs of the terminal to scrape the insulation off said wire as it enters down into the slot. In this manner both electrical and mechanical connection between the wire and the slotted terminal are effected.

One disadvantage of the prior structure occurs as a result of relaxation of the metal of both the wire and the terminal, but usually mostly occurring in the wire, whether it is copper or aluminum. Such relaxation tends to loosen the wire in the slot making it easier for an unauthorized withdrawal or, in fact, a dropping out of the wire from the slot under certain environmental conditions. Furthermore, such relaxation can permit air to enter between the wire and the walls of the slot to cause oxidation with resulting deterioration of the electrical contact.

Another disadvantage of the prior art structure occurs when employed with magnet wires, particularly those which are coated with one of the newer insulations, such as polyester amide/imide coating thereover. Investigation has shown that such insulations are often not sufficiently removed from the wire in that a residue of such insulation remains between the wire and the walls of the slot after insertion of the wire, thereby impairing the electrical connection.

BRIEF STATEMENT OF THE INVENTION

Accordingly a primary object of the invention is a U-shaped terminal of the type having a slot extending across the transverse section thereof and down into the legs and which is constructed to not only more effectively remove the insulation from wires, such as magnet wires having polyester type insulation but also will function to retain a long term constant spring-like force against the bared metal of the wire, thereby ensuring better electrical and mechanical connection of said wire.

A second aim of the invention is a U-shaped slotted terminal wherein a first portion of the slot extends across the transverse section and down into the legs thereof to ovalize the wire, and with the walls of said slots having shoulders formed in that portion of the slots extending into the legs and further with a narrowed portion of said slots extending from said shoulders farther down into said legs, said shoulders functioning to engage and tear away the insulation from the ovalized wire as the wire moves down into said slot past said shoulders.

A third purpose of the invention is a U-shaped terminal of the type described with slots extending across the transverse section and down into the legs thereof, and with said legs lying generally in planes which converge towards said transverse section to cause the walls of said slot to, in effect, move longitudinally along the wire as it is inserted in the slot, thereby effectively scraping the insulation from the wire and making good electrical and mechanical connection therewith.

A fourth purpose of the invention is a U-shaped terminal with a wire entering slot extending across the transverse section thereof and down into the legs thereof as described above with a combination of cooperating features therein including insulation removing shoulders in said slots, and with the legs lying in converging planes, and further having additional slots formed in the legs on either side of the wire-entering slot; and with all of said features coacting together to provide an effective removal of insulation from a wire inserted in the wire receiving slot and subsequently maintaining a constant, sustained force on said bared metal of the wire.

A fifth aim of the invention is to improve terminals of a generally U-shaped configuration having slots extending across the transverse section and down into the legs thereof generally.

A still further aim of the invention is a slotted terminal consisting of at least one plate-like element having a slot formed therein and opening onto one edge of the plate-like element for receiving a wire and gradually narrowing to a dimension less than the wire diameter to ovalize the wire as it enters said plate, and having a pair of shoulders formed therein below said gradually narrowing portion to remove insulation from said wire as the wire passes thereby and with an even further narrowed portion of the slot extending below said shoulders to receive and grip said wire.

In accordance with one preferred form of the invention there is provided a terminal having a U-shaped configuration consisting of a pair of plate-like legs joined together at one end thereof by a transverse section. A slot is formed across said transverse section between said legs and extending down into said legs. The slot is relatively wide across the transverse section to permit easy entry of a wire and then becomes narrow as it enters said legs, to position and sometimes to ovalize the wire being inserted. An abrupt narrowing of the slot width occurs in the legs of the terminal by means of ledges or shoulders formed in the slot walls in the legs which function to scrape off the insulation from the flattened sides of the wire as said wire is forced therepast. Below the shoulders the slot width becomes even narrower than the ovalizing portion and is constructed to tightly grip that portion of the wire from which the insulation has been removed by the shoulders to form good electrical and mechanical connections.

In accordance with one feature of the invention the said legs of the U-shaped terminal lie in planes which converge towards the connecting transverse element to cause the edges of the slot to move longitudinally along the wire as said wire enters the slot, thereby providing a scraping effect on the wire which aids in removing the insulation therefrom.

In accordance with another feature of the invention additional apertures or slots are formed in the legs on both sides of the wire entering slot, to create beam-like elements on the sides of the wire-entering slot. These beam-like elements are forced apart within their elastic limits when a wire is inserted therebetween and thereby maintain a constant, long term spring-like force against that portion of the wire from which the insulation has been removed.

BRIEF DESCRIPTION OF THE DRAWINGS

The above-mentioned and other objects and features of the invention will be more fully understood from the following detailed description thereof when read in conjunction with the drawings in which:

FIGS. 10 and 11 show the action of the slots upon the wire when such slots are formed in legs lying in substantially divergent planes;

FIGS. 12 and 13 respectively show the condition of the insulation of the wire as it first begins entering the narrow slot portion of the structure of FIGS. 10 and 11 and the stripping away of the insulation and the resultant scraped wire caused by the effective longitudinal movement of the edge of the slots as the wire enters into said slots in legs which lie in divergent planes.

DETAILED DESCRIPTION OF THE INVENTION

Figure 1:
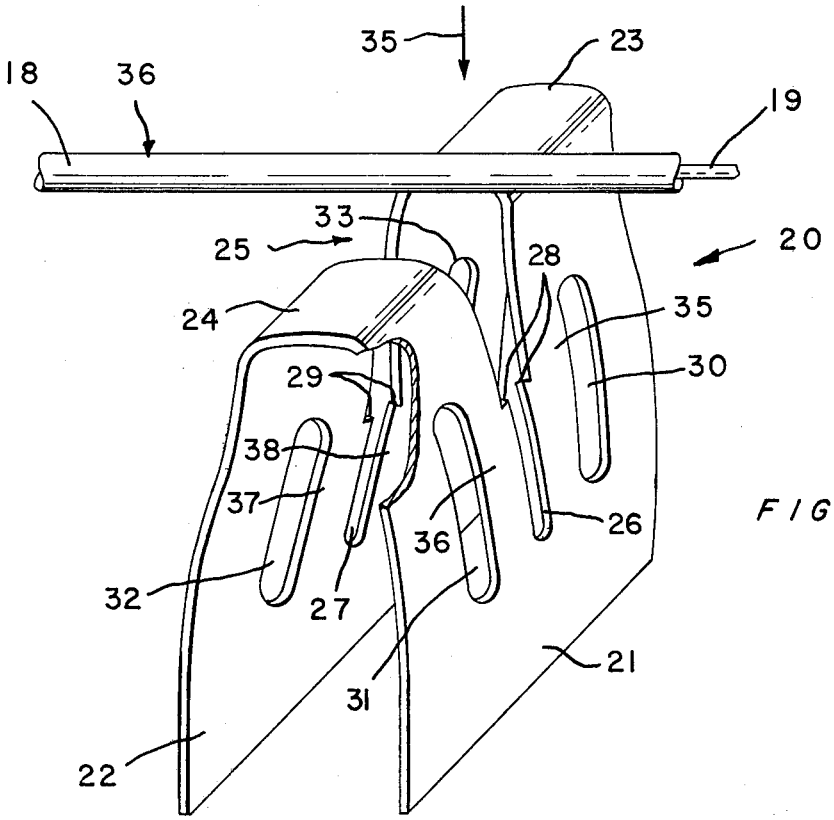
FIG. 1 shows a form of the invention embodying all three features including shoulders located in the wire entering slots formed in the legs of the U-shaped terminal, additional slots parallel and adjacent to the wire entering slot in the legs and the legs of the terminal lying in substantially divergent planes.

Referring to FIG. 1 the inverted U-shaped terminal 20 comprises a pair of curved, plate-like legs 21 and 22 secured together at their upper ends by a transverse section denoted generally by reference characters 23 and 24. Between the transverse sections 23 and 24 is a slot 25 which extends downwardly into the legs 21 and 22.

The slot 25 is wider at the top thereof, that is between the transverse sections 23 and 24, than it is at its lower portions 26 and 27. More specifically, the narrowed portions 26 and 27 of the slot begin at the junction of the pairs of shoulders 28 and 29 which are formed in the walls of the two leg portions 21 and 22. The width of at least one of the narrow slot portions 26 and 27 is designed to be less than the diameter of the inner wire 19 of conductor 36, which conductor is moved downwardly in the direction of arrow 35 into the slot 25. As the wire passes the pairs of shoulders 28 and 29, said shoulders 28 and 29 bite into the insulation 18 of conductor 36 and literally tear away said insulation to expose the metal of the wire thereunder. Continued insertion of conductor 36 into the slots 26 and 27 will result in the sides of the walls defining at least one of the slots 26 and 27 biting into the metal wire 19 of conductor 36.

As indicated above, either one or both of the slots 26 and 27 can have a width of sufficient narrowness to bite into the metal wire 19 of conductor 36. Alternatively, one of the slots, such as slot 27, can be sufficiently narrow to cut into the insulation 18 and also to perhaps make relatively slight contact with the wire of conductor 36, but not to bite significantly therein, thereby performing primarily an anti-strain function. The other slot 26 can be narrower and will bite into the metal wire 19 of conductor 36, thereby making a good electrical contact.

Apertures or slots, such as slots 30, 31, 32 and 33 are formed in the legs 21 and 22 of terminal 20 on one or both sides of the wire-entering slots 26 and 27. The addition of slots 30 through 33 function to leave a beam-like element between the slots 30 through 33 and the wire entering slots 26 and 27. Specifically such beams are identified by reference characters 35, 36, 37 and 38.

The beams 35 to 38 are designed to deflect away from each other as the conductor 36 is inserted down into the slots 26 and 27, but within elastic limits of said beams 35 through 38, even though some permanent distortion of beams 35–38 might occur. Thus, the beams 35 to 38 will function to maintain a sustained and a long term spring-like force upon the scraped portion of wire portion 19 of conductor 36 inserted therebetween in slots 26 and 27.

The two plate-like legs 21 and 22 of the U-shaped terminal 20 of FIG. 1 are not flat and parallel to each other but can be seen to be generally curvilinear and to lie generally in planes which converge in the direction of the transverse elements 23 and 24. Thus, as conductor 36 is forced down into slots 26 and 27 those edges of legs 21 and 22 defining said slots 26 and 27 will move longitudinally in opposite directions away from each other along the conductor 36, thereby performing the function of not only scraping the insulation of conductor 36 but literally plowing into the metal wire 19 contained within conductor 36.

It is to be noted that the shoulders 28 and 29 initially will bite into and tear the insulation coating 18 of conductor 36 away from the wire 19 contained therein, thus facilitating further removal of the insulation from conductor 36 and the plowing into the wire therein by the sides of the slots 26 and 27.

Before continuing with the discussion of the other forms of the invention shown in FIGS. 2, 3, 4 and 5, reference is made to FIGS. 6, 7, 8, 9, 10, 11, 12 and 13 which illustrate in detail the action of the various features of FIG. 1 upon the wire inserted in the slots 26 and 27 thereof.

Figure 6:
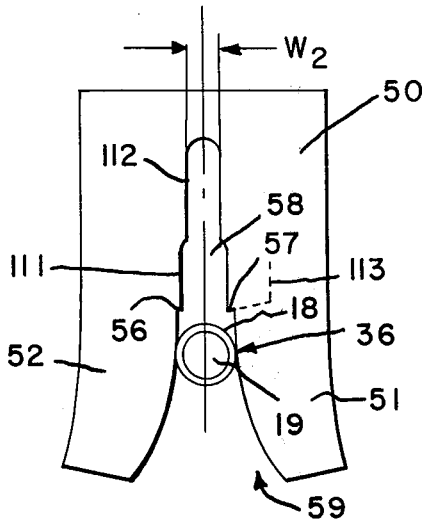
FIGS. 6 and 7 are schematic type diagrams showing the effect of the shoulders in the wire-entering slot upon the insulation and metal wire of a conductor being forced therein.

In FIG. 6 the conductor 36 is shown entering a slot 59 before it has passed the pair of shoulders 56 and 57. The conductor 36 is comprised of insulation coating 18 around conductive inner wire 19. In FIG. 6 the ends 52 and 51 of the bifurcated element 50, corresponding generally to the plate 21 and slot 26 of FIG. 1, are shown as being spread apart by conductor 36 being inserted therein.

The plate 21 and the slot 26 of FIG. 1 are shown as being forced apart somewhat as the conductor 36 is forced therebetween. The force created between the conductor 36 and the ends 52 and 51 of bifurcated element 50 cold works the metal of conductive inner wire 19 to cause ovalization thereof, as indicated in FIG. 6, with the major axis of the ovalized wire being parallel to the general direction of the slot 59 and the minor axis being perpendicular thereto. Such ovalization of wire 19 results in surfaces of greater radius being presented to the sharp-edged shoulders 56 and 57 as the conductor 36 is inserted in slot 59 past said shoulders. Thus, the shoulders 56 and 59 will remove the insulation from conductor 36 over larger areas than would be the case if no ovalization had occurred. Ovalization further facilitates proper orientation of the conductor as it enters further into the slot 59. It is to be noted that ovalization of the wire 19 prior to its passing shoulders 56 and 57 is not required for all applications of the invention.

As indicated above, the primary function of shoulders 56 and 57 is to remove the insulation 18 of conductor 36 as said conductor 36 is moved from portion 106 of slot 59 past the shoulders 56 and 57, thereby exposing the bare metal of the wire 19 to the sides of portion 110 of slot 59, and also to the sides of the even narrower portion 112 of slot 59. Additional ovalization of wire 19 occurs in slot portion 112 in which the wire 19 is finally positioned.

The narrowing of slot 59 of FIG. 6 in two stages 110 and 112 below shoulders 56 and 57 is a result of the method in which the shoulders 56 and 57 are formed. For example, the shoulder 57 is formed by making a cut, indicated by broken line 113, in the bifurcated end portion 51. The cut 113 extends from the junction of slot portions 106 and 110 towards the outer side 109 of terminal 50 and then extends towards the end 108 of terminal 50, thereby partially separating a small portion 107 of bifurcated end 51 from the main body of bifurcated end 51 and forcing said separated portion 107 a small distance into the slot 59. The aformentioned small distance forms the shoulder 57.

The forcing of the small portion 107 into slot 109 is caused by the physical working of the metal as the cut 113 is made in that the cutting tool acts as a wedge to bend section 107 slightly into the slot 109, thereby creating the shoulder 57.

However, if the edges of slot portion 110 are parallel prior to the cuts, such as cut 113, being made in legs 51 and 52, the making of such cuts and the subsequent bending into slot 59 of the small elements defined thereby, such as small element 107, will cause the edges of portion 110 to converge towards the open end of slot 59. Consequently, as the ovalized wire 19 passes shoulders 56 and 57 and moves into slot portion 110, the edges of slot portion 110 will tend to become separated from the wire 19 with a resultant loss of electrical contact. To accommodate for such loss of contact between wire 19 and the edges of slot portion 110 the even more narrower slot portion 112 is provided into which the conductor 36 ultimately is forced. The walls of slot portion 112 can be parallel or even slightly convergent towards the closed end thereof.

It is possible to fabricate slot 59 so that the edges of slot portion 110 converge slightly towards the open end of slot 59 prior to the making of cut 113, so that they would become substantially parallel after the cut 113, thereby eliminating the need for the two portions 110 and 112.

It will be noted that there is a difference between the configuration of slot 59 of FIG. 6 and the configuration of slot 25 of FIG. 1, in that the narrowing of slot 59 below the shoulders 56 and 57 in FIG. 6 occurs in two stages 110 and 112, whereas the slot 25 of FIG. 1 has only one width below shoulders 28.

While the structure of FIGS. 1, 2, 4 and 5 do not show such a two stage slot beyond corresponding shoulders 56 and 57 of FIG. 6 it is to be understood that such two stage slots can be incorporated into each of the structures of FIGS. 1, 2, 4 and 5.

Figure 8:
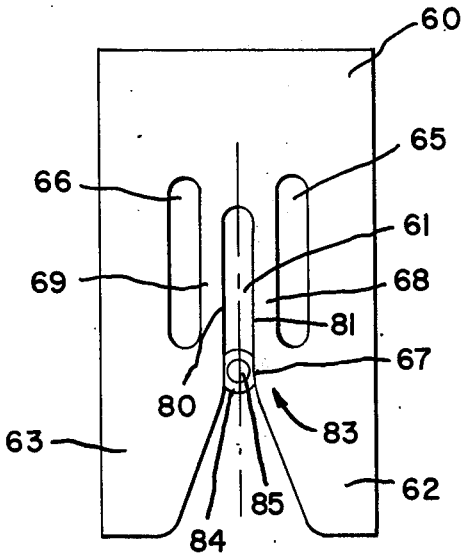
FIGS. 8 and 9 illustrate the effect of the additional slots adjacent the wire-entering slot to provide beams which will resiliently give as the wire is forced therebetween substantially within their elastic limits to maintain a sustained and constant spring-like force upon the wire.
Figure 9:
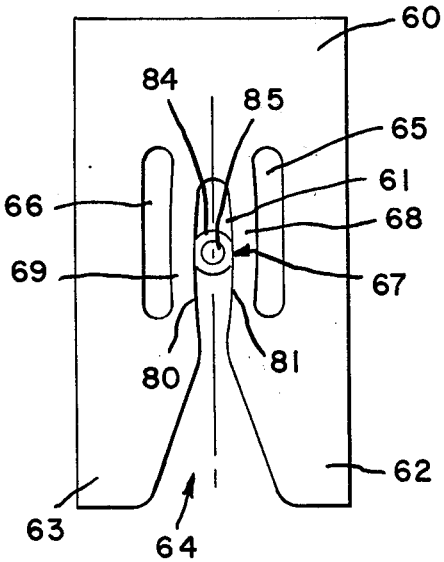

Referring now to FIGS. 8 and 9 there is shown the effect of slots 66 and 65 positioned longitudinally along either side of the wire receiving slot 61 to form a pair of beams 69 and 68 whose inner edges 80 and 81 define the edges of said wire receiving slot 61.

The two beams 69 and 68 are supported at both ends by the main portion of the legs 60 of the terminal, but, however, are constructed to give, at least within their residual limits of elasticity, when the conductor 67 is almost fully inserted in the slot 61, as shown in FIG. 9. Because the beams 68 and 69 give within their limits of elasticity they maintain a spring-like force against the conductor 67 over a sustained length of time.

In the structures using the auxiliary slots 30–33 (FIG. 1) alongside the wire receiving slots 26, 27 to form beams 35–38 as also shown in FIGS. 2, 3, 5, 8 and 9, it is to be understood that when wires are inserted therein the beams will usually bend beyond their limits of elasticity and become permanently deformed. However, there will be a residual or remnant degree of elasticity remaining in the beams which will continue to maintain a spring-like force against the wires inserted therebetween. In other words, even though a beam has been bent beyond its limits of elasticity from a given position, it will establish a new amount of bending within its elastic limits from a new point of reference position.

Figure 7:
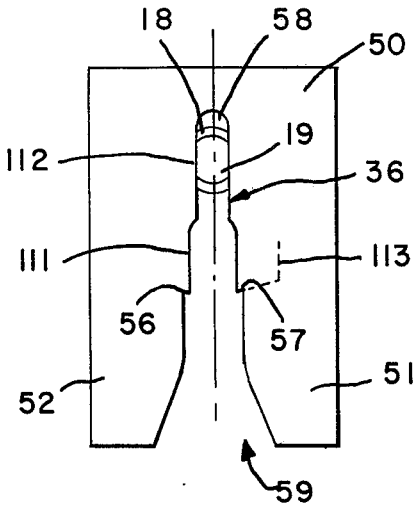

When the structure of FIGS. 6 and 7 are combined with divergent leg members, as in FIG. 1, the beams 35–38 exert force upon the wire both in a direction towards each other and also in a direction normal to the planes of the legs 21 and 22.

It is to be noted further that the width of the slot 61 is less than the diameter of the metal wire 85 within the conductor 67, to thereby cut through the insulation 84 thereon and bite into said metal wire 85 to make a good electrical connection therewith, as well as a good mechanical connection.

While the edges 80 and 81 of the beams 68 and 69 are shown as being straight in FIG. 8 they can be slightly concave or even convex in order to provide spring-like forces with certain characteristics upon the conductor 67 after it is inserted in the slot 61.

If the edges 80 and 81 of slot 61 are concave with respect to each other, then the entrance to the slot 61 can be made considerably narrower than the main body of the slot 61 lying between the beams 68 and 69 to make certain that the insulation is stripped from the wire 67 and that the metal itself is cold worked by the edges of slot 61. As the conductor 67 enters into the narrow portion of slot 61, where the force on the conductor is the greatest, the bifurcated portions 62 and 63 will tend to spread apart to permit the conductor 67 to enter into the main body of the slot. However, because of the narrowed width of the slot at the point 83 thereof, the insulation on the wire conductor 67 will be effectively removed so that as the conductor 67 enters into the main body of slot 61 the edges 80 and 81 of said slot will meet the bare metal wire of the conductor and will dig further thereinto to make good electrical and mechanical connection therewith.

On the other hand, if inner sides 80 and 81 defined by the slot 61 are slightly convex with respect to each other, the force on the conductor 67 can be made to increase as the conductor 67 enters into the main body of slot 61.

Further, the structure of FIGS. 8 and 9 can be designed so that the beams 68 and 69 can exert either a greater or a lesser force upon the conductor 67 as it enters thereinbetween by making the beams 68 and 69 smaller or greater in cross-sectional area. It is apparent that the smaller the cross-sectional area the greater the deflection of the beams 68 and 69 must be in order to maintain a given force upon the conductor 67. On the other hand, the greater the deflection of the beams 68 and 69, the less critical will be the dimensional tolerances of the slot 61. Accordingly, the cross-sectional area of the beams 68 and 69, the width of the slot 61 and the convexity or concavity of the inner surfaces 80 and 81 are largely matters determined by the needs of a particular application.

Referring now to FIG. 10 there is shown the effect of the positioning of the main legs 71 and 72 of a U-shaped terminal in divergent planes upon the conductor 73 inserted in a slot 96 (FIG. 11) formed therein. In FIG. 10 the conductor 73 is shown fully inserted in the slot designated by reference character 96 in FIG. 11, and is also shown as conductor 73' partially inserted in said slot 76.

As conductor 73 is initially moved into the slot 76 the insulation is scraped from said conductor 73 along lines 90 and 91 shown in FIG. 12. Because the two legs 71 and 72 lie in divergent planes, said legs 71 and 72 have the effect of moving away from each other as the conductor 73 is moved further into the slot 76, thereby scraping the insulation 100 from the conductor 73 and exposing metal wire 98.

In FIG. 10 the lines 90 and 91 indicate the line where the insulation was initially scraped from the wire 98. FIG. 10 also shows that the legs 71 and 72 have, in effect, moved outwardly from the lines 90 and 91, scraping additional insulation from the wire and causing the edges of the grooves of the slots, such as slot 96 in leg 72, to dig into the metal portion 98 of the conductor 73, thereby making good electrical and mechanical connections.

FIGS. 12 and 13 show profiles of the conductor 73 both as it is when it initially enters the slot 96 of FIGS. 10 and 11, (FIG. 12), and as it is in its final position (FIG. 12) after full insertion in said slot 96 of FIG. 11.

In FIG. 12 the insulation has been removed between the lines 90 and 92 on the left hand side of FIG. 12 and between the lines 91 and 93 on the right hand side of FIG. 12. When the conductor 73' is fully inserted in the slot the insulation has been removed between the lines 90 and 94 on the left in FIG. 13 and between the lines 91 and 95 on the right hand side in FIG. 13.

Figure 14:
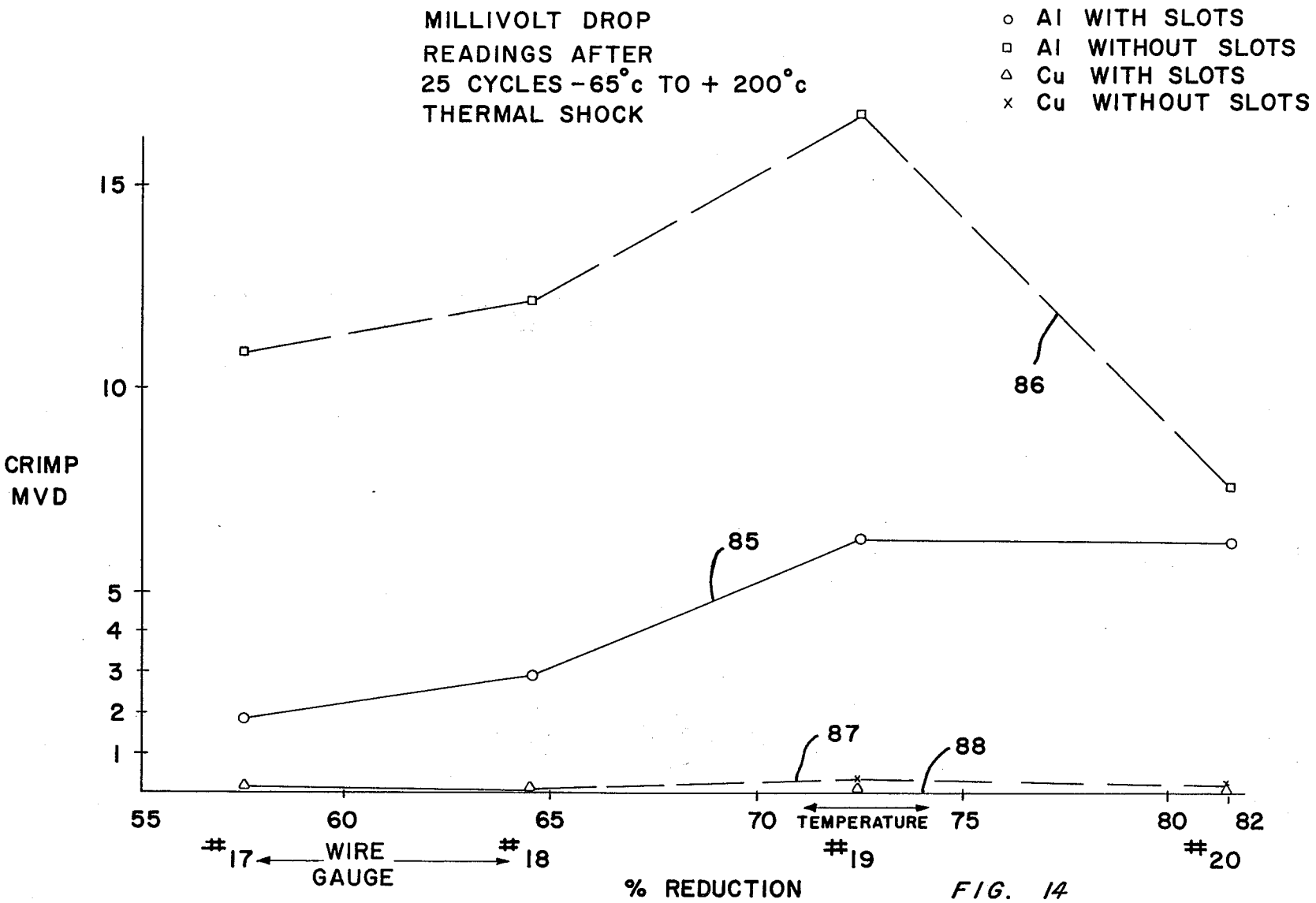
FIG. 14 is a chart relation between the millivolt drop reading between the wire and the terminal of the structure of FIG. 1 with various sized wires over a 25 cycles of testing operation at various temperatures.

In FIG. 14 there are shown four curves 85–88, each representing the millivolt drop across the conductor-terminal connection after 25 test cycles between −65° and 200° C. thermal shock, for both aluminum and copper, with and without slots in the terminal, such as the slots shown in FIGS. 8 and 9, for example, which exist on either side of the wire receiving slot. More specifically, in FIG. 14 the two curves 85 and 86 represent the millivolt drop of aluminum wire of varying sizes from No. 17 to No. 20, as shown along the X axes in the chart, with and without slots, respectively. The two curves 88 and 87 show the millivolt drop of copper wire of varying sizes from No. 17 to No. 20 subjected to the same tests as the aluminum wire discussed above.

Figure 2:
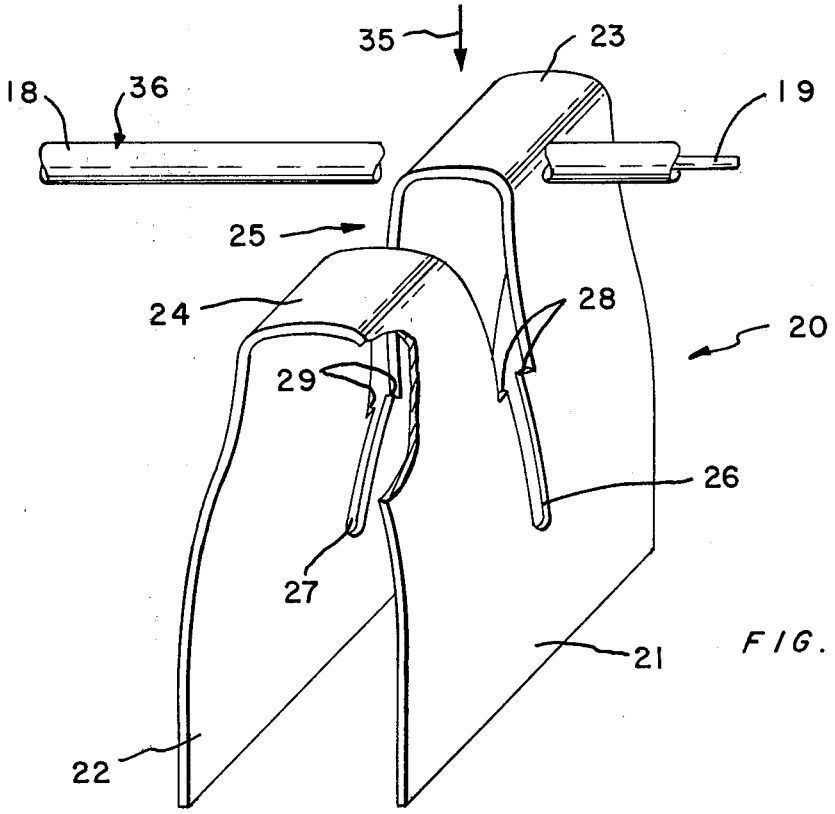
FIG. 2 shows another form of the invention similar to that of FIG. 1 but without the additional slots adjacent the wire entering slot.

Referring now to FIG. 2 there is shown a form of the invention similar to that of FIG. 1 except that the slots 30 through 33 have been omitted. Features of the structure of FIG. 2 include the shoulders 28 and 29 as well as the fact that the two legs 21 and 22 of the terminal lie in divergent planes, said features corresponding, respectively, to the shoulders 28 and 29 of FIG. 1 and to the relative planar positions of legs 21 and 22 of FIG. 1.

Figure 3:
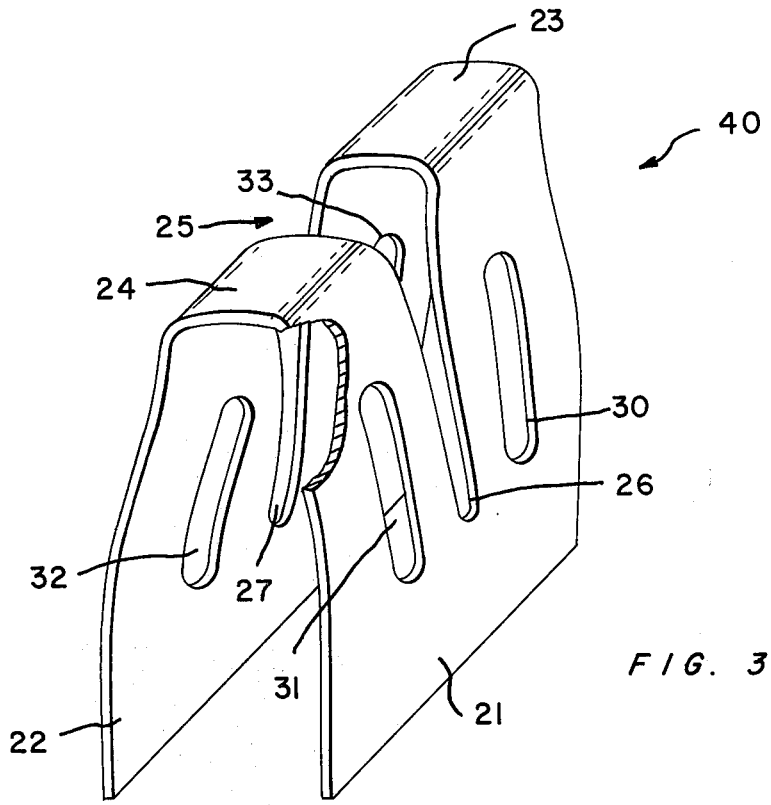
FIG. 3 shows another form of the invention similar to that of FIG. 1 except that the shoulders in the wire-entering slots are not present.

FIG. 3 shows a structure similar to that of FIG. 1 except that shoulders, such as shoulders 28 and 29 of FIG. 1, are not present in FIG. 3. Thus, the features of FIG. 3 include slots 30, 31, 32 and 33, which aid in maintaining a sustained force on the wire inserted in slots 26 and 27, and the fact that the two legs 21 and 22 lie in divergent planes.

Figure 4:
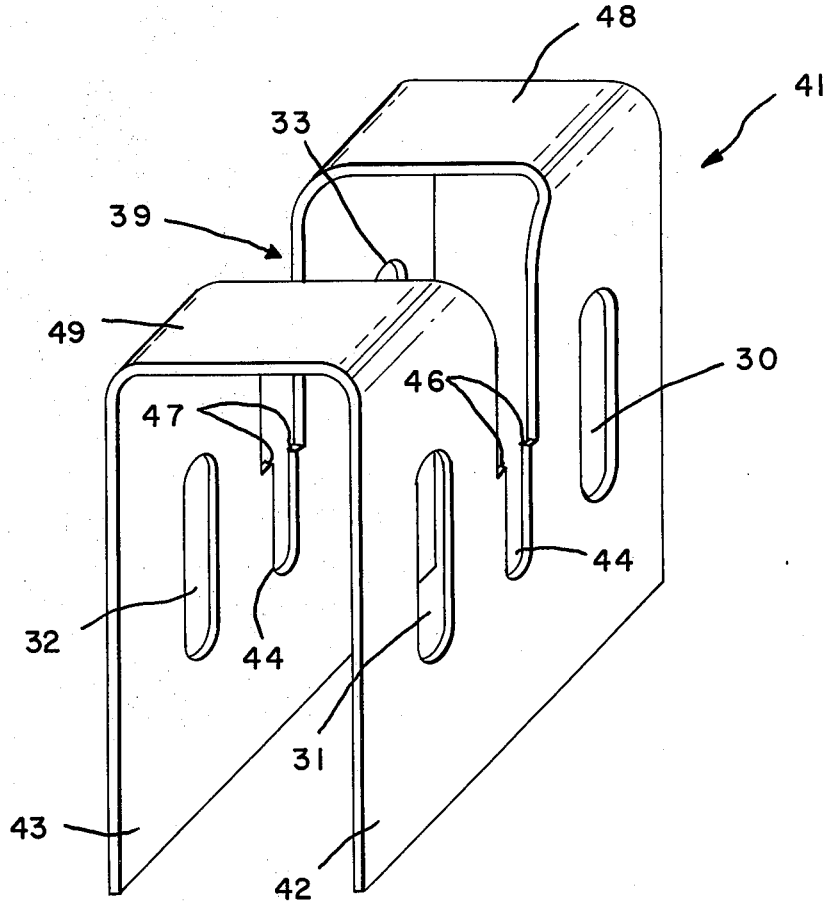
FIG. 4 shows another form of the invention similar to that of FIG. 1 except that the planes of the two legs of the terminal lie in substantially parallel planes rather than divergent planes.

In FIG. 4 there is shown another structure similar to that of FIG. 1 except that legs 42 and 35, which correspond to legs 21 and 22 of FIG. 1, do not lie in divergent planes but rather are substantially parallel with each other. Legs 42 and 43 are joined together by a transverse section represented by elements 48 and 49 which have a slot 39 formed therein. The wide slot 39 becomes narrower until it reaches the shoulders 46 and 47 where it becomes abruptly narrower and thereafter is defined by the narrow slots 44 and 45 which ultimately receive the conductor inserted therein. As in the structure of FIG. 1, either or both of the slots 44 and 45 can be sufficiently narrow to penetrate through the insulation and into the metal wire to make electrical and mechanical connection therewith. Alternatively, one of the slots 44 and 45 can be somewhat less narrow to bite only into the insulation thereof and provide an anti-strain function.

Further, the terminal of FIG. 4 has slots 30 through 34 therein corresponding to slots 30 through 34 of FIG. 1 on either side of the wire receiving slots 44.

Figure 5:
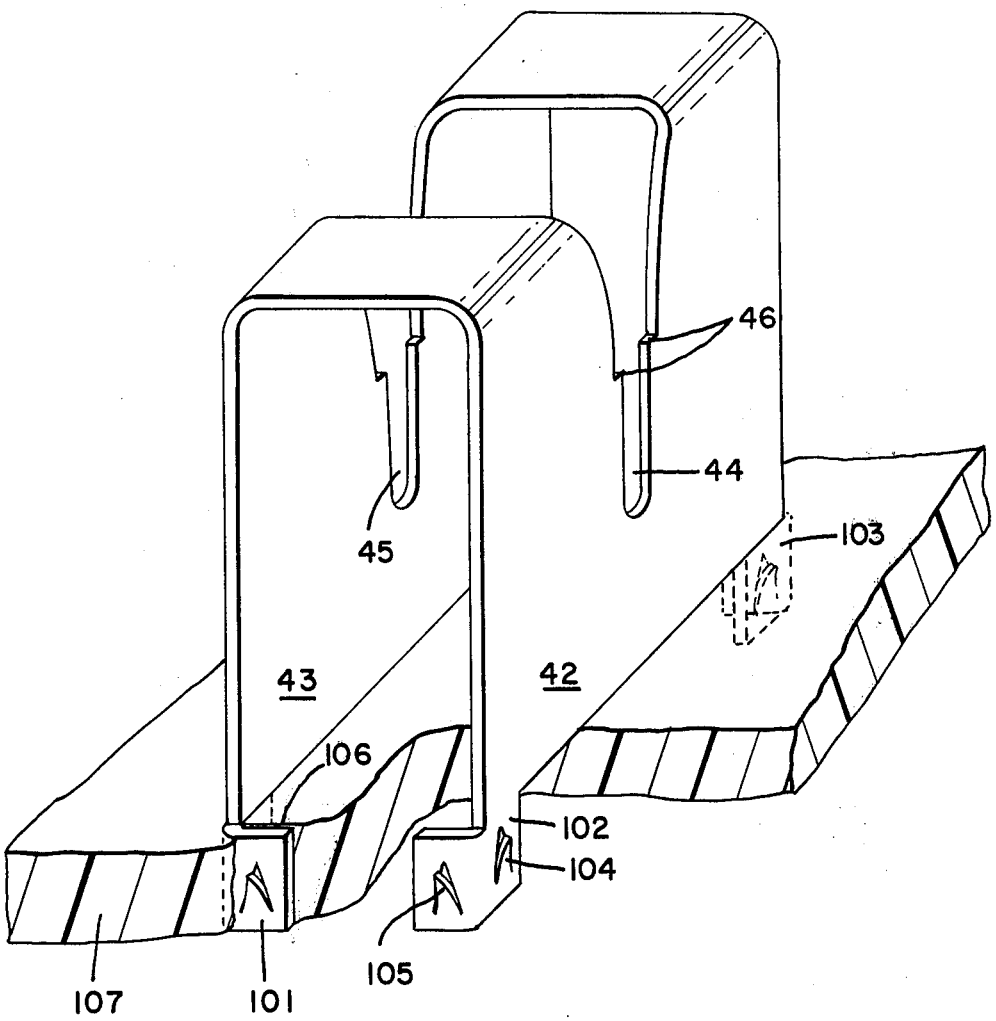
FIG. 5 is another form of the invention employing only the feature of the shoulders in the slots in the legs of the U-shaped terminal and without the use of divergent planes of the legs of the terminal and without the use of additional slots parallel and adjacent the wire-entering slots in the legs.

FIG. 5 shows another form of the invention in which the legs 42 and 43 of the U-shaped element lie in parallel planes rather than in divergent planes. Furthermore, the structure of FIG. 5 has no slots therein corresponding to slots 30 through 33 of FIG. 1. However, the structure of FIG. 5 does have a pair of shoulders 46 and 47 formed therein corresponding to the shoulders 46 and 47 of FIG. 4 and which perform the same function. Below the shoulders 46 and 47 are narrowed slots 44 and 45.

The structure of FIG. 5 has means, such as legs 101, 102 and 103 for securing the terminal upon a base 107, which can be a circuit board or part of a housing. The legs 101–103 are inserted in suitable apertures, such as aperture 106 in base 107, and each leg can have tangs, such as tangs 104 and 105 on leg 102, which grip the walls of the associated aperture in base 107. Various means other than the legs 101–103 can be employed to mount the terminal upon a base. For example, a wire receiving barrel, a spade, a ring tongue, or other type terminal can be attached to the structure of FIG. 5. Similarly, the structure of FIGS. 1, 2, 3 and 4 can be attached to a base means or formed with other type terminals.

It is to be understood that the forms of the invention shown and described herein are but preferred embodiments thereof and that various changes can be made in the design and in proportional sizes and dimensions without departing from the spirit and scope thereof.

I claim:

1. In an electrical connecting device of the type comprising a plate-like sheet metal member having a wire-receiving end and having a wire-receiving slot extending inwardly from said wire-receiving end, said slot having opposed edges and having an inner end portion which constitutes a wire contacting portion, said opposed edges being spaced apart by a distance which is less than the diameter of a wire for which said device is intended, the improvement to said connecting device comprising:

at least one generally L-shaped cut line in said plate-like member, said cut line having a first portion which extends transversely from one of said edges of said slot and having a second portion which extends from said first portion generally parallel to said slot towards said inner end portion of said slot, a shoulder on said one edge of said slot which faces said wire-receiving end of said plate-like member, said shoulder being located at said first portion of said cut line, said wire contacting portion extending from said shoulder towards said inner end whereby, upon movement of a wire laterally of its axis and into said slot and into said wire contacting portion, said shoulder penetrates the insulation of said wire and electrical contact is established with said wire in said wire contacting portion.

2. An electrical connecting device as set forth in claim 1 having an L-shaped cut line extending from the other edge of said slot transversely from said other edge and having a portion extending generally parallel to said slot towards said inner end, and having a shoulder on said other edge.

* * * * *